United States Patent [19]

Obayashi

[11] Patent Number: 4,663,783

[45] Date of Patent: May 12, 1987

[54] GLOVE

[76] Inventor: Masaru Obayashi, 1866-5 Muromachi, Takamatsu-shi, Kagawa-ken, Japan

[21] Appl. No.: 845,307

[22] Filed: Mar. 28, 1986

[30] Foreign Application Priority Data

Jul. 6, 1985 [JP] Japan ..... 60-103301[U]
Aug. 23, 1985 [JP] Japan ..... 60-129264[U]

[51] Int. Cl.[4] ..... A41D 19/00
[52] U.S. Cl. ..... 2/161 A; 2/164
[58] Field of Search ..... 2/158, 159, 161 R, 161 A, 2/164, 167

[56] References Cited

U.S. PATENT DOCUMENTS 2,864,091 12/1958 Schneider ..... 2/161 R
3,114,915 12/1963 Gross ..... 2/164 X
3,267,486 8/1966 Madnick ..... 2/164
3,416,158 12/1968 Kulman ..... 2/161 R
3,882,548 5/1975 Shinagawa et al. ..... 2/161 A
3,918,096 11/1975 Lim ..... 2/161 A
4,214,321 7/1980 Nunayser ..... 2/161 R X
4,559,646 12/1985 Ertl ..... 2/161 R X
4,570,269 2/1986 Berlese ..... 2/20 X
4,583,248 4/1986 Edwards et al. ..... 2/164

FOREIGN PATENT DOCUMENTS 123746 10/1972 Norway ..... 2/161 R

*Primary Examiner*—Henry S. Jaudon
*Assistant Examiner*—Tracy G. Graveline
*Attorney, Agent, or Firm*—Millen & White

[57] ABSTRACT

A glove wherein installed between an outer leather wall member (11) and an inner wall member (14) or outside said outer leather wall member (11) is a molded heat insulator (12) of flexible material so formed as to be capable of covering only a back side (1) and fingertips (7).

8 Claims, 13 Drawing Figures

GLOVE

BACKGROUND OF THE INVENTION

1. Field of the Invention

The present invention relates to a glove used mainly for skiing, playing ice hockey and motorcycling and more particularly it relates to a warmth retention construction for such gloves.

2. Description of the Prior Art

Conventional gloves of this type, for example, ski gloves incorporate a heat insulator, such as sponge, disposed between the outer leather wall member and the inner wall member for warmth retention purposes.

In the conventional glove, however, since both the back and palm sides of the glove are provided with a heat insulator (sponge) which is relatively thin and uniform in thickness for warmth retention, particularly the back and fingertips of the glove, which are liable to be subjected to the wind, are not satisfactory in protection against the cold. To increase protection against the cold, it would be effective to increase the thickness of the heat insulator, but this would make it difficult for the user wearing the glove to bend the palm side of the glove when gripping an article (for example, a ski stock) and the sense of gripping the article would be dull.

SUMMARY OF THE INVENTION

The present invention is characterized in that as a means for solving said problem there is provided between an outer leather wall member and an inner wall member a molded heat insulator of flexible material so molded that it is capable of covering only the back and palm sides of the glove.

Thus, the back and fingertips of the glove of the present invention, which are liable to be subjected to the wind, are satisfactorily protected against the cold and yet the ease which the palm side of the glove is bent is not reduced at all.

DESCRIPTION OF THE PREFERRED EMBODIMENTS

Figure 1:
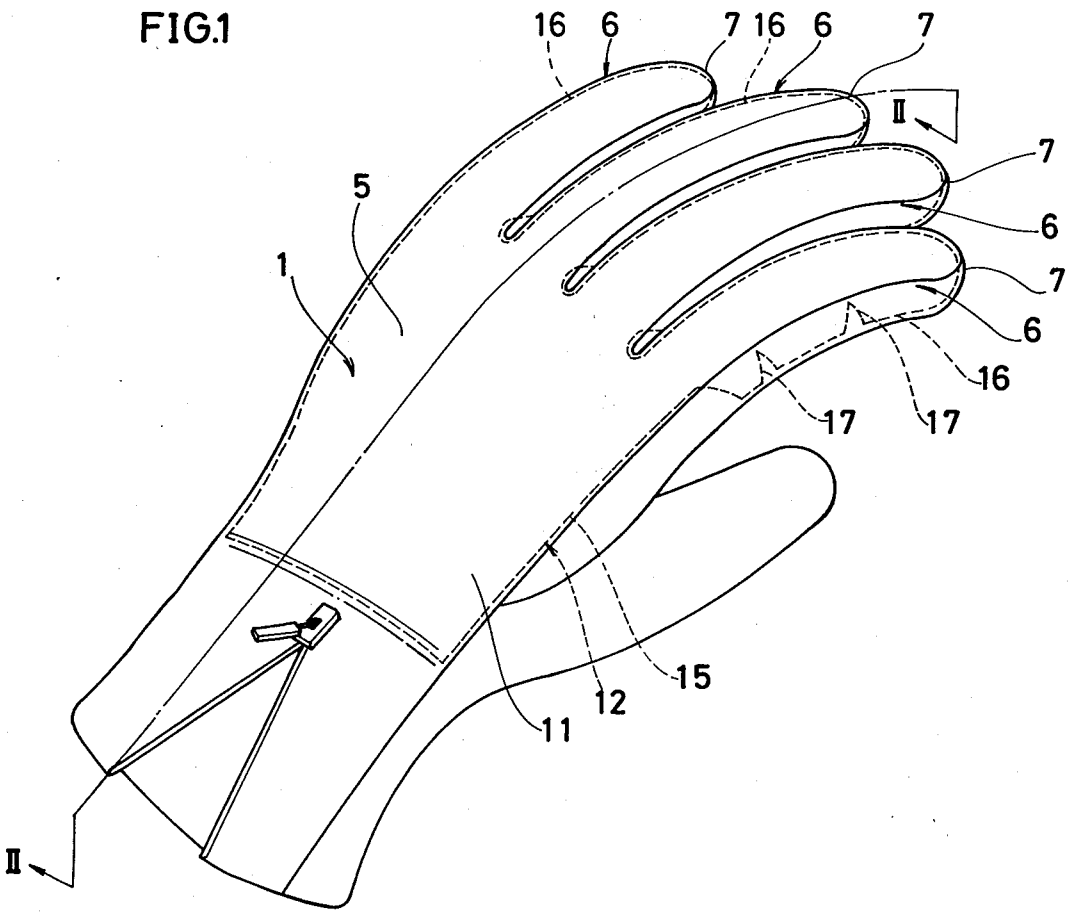
FIG. 1 is a perspective view of a glove according to an embodiment of the invention.

A preferred embodiment of the invention will now be described with reference to FIGS. 1 through 4. The glove of this embodiment is formed for use in sports, such as skiing, in such a manner that disposed between an outer leather wall member 11 and an inner wall member 14 are an overall surface covering heat insulator 13 for covering the entire surfaces of both the back and palm sides 1 and 2 of the glove and a molded heat insulator 12 so molded as to be capable of covering only the regions of the back side 1 and fingertips 7.

The outer leather wall member 11 is made by sewing in the usual manner, using natural or synthetic leather.

The overall surface covering heat insulator 13 is made of sponge and relatively thin.

Figure 2:
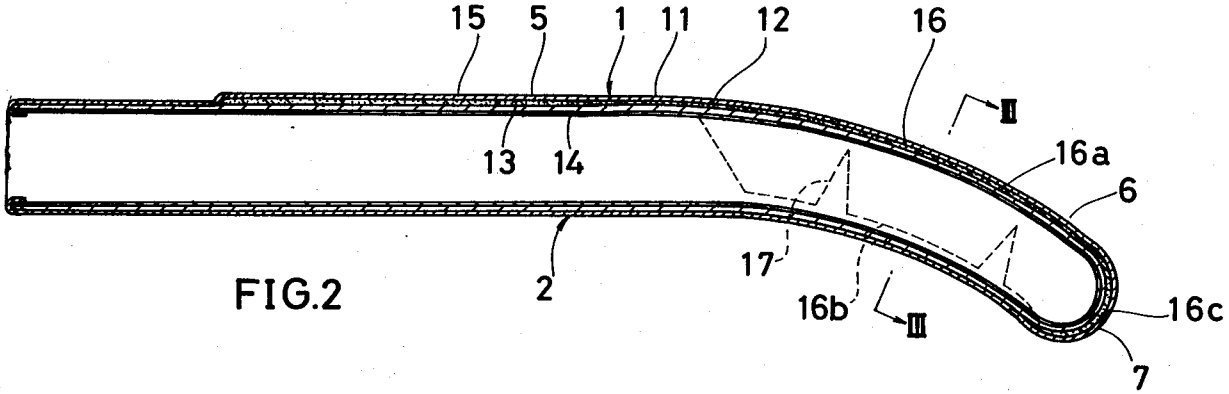
FIG. 2 is a sectional view taken along the line II—II of FIG. 1.
Figure 4:
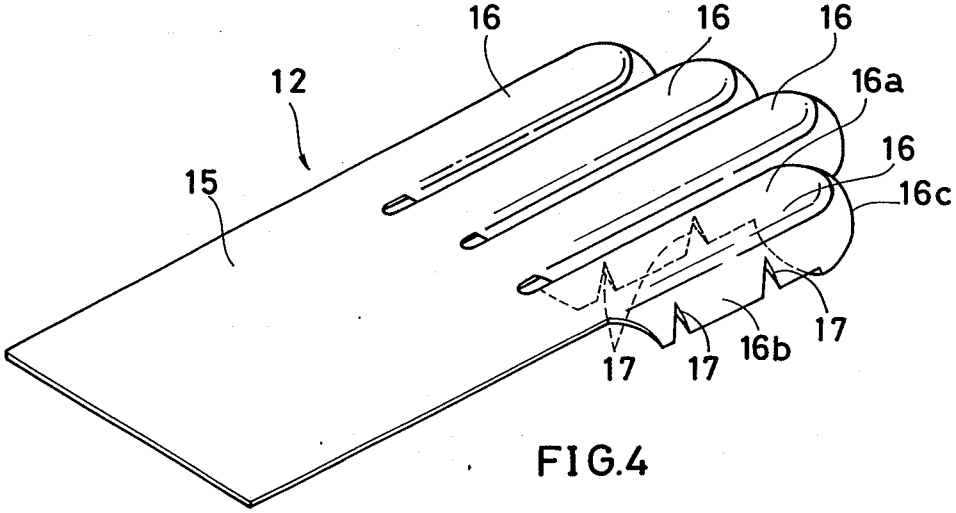
FIG. 4 is a perspective view of a molded heat insulator used in the glove of FIG. 1.

The molded heat insulator 12 is made of relatively soft foam resin material so that, as shown in FIG. 4, a back covering portion 15 for covering the back of the glove and finger covering portions 16 for covering the four fingers 16 other than the thumb are integrally molded. In this embodiment, the back covering portion 15, as shown in FIGS. 1 and 2, has about 3/5 of the total area of the back side 3, occupying the area nearer to the finger compartments 6. Each finger compartment 6 has a finger back covering portion 16*a*, opposite lateral finger side covering portions 16*b* and a fingertip covering portion 16*c*. The opposite lateral finger side covering portions 16*b* are gradually thinned toward the finger flat sides and are formed with wedge-shaped notches 17 at positions corresponding to the finger joints so that when the glove incorporating the molded heat insulator 12 is used, the opposite lateral finger side covering portions 16*b* may not interfere with the bending of the fingers.

Figure 3:
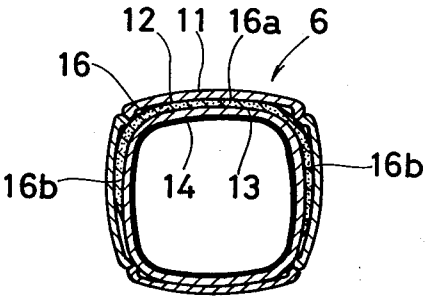
FIG. 3 is a sectional view taken along the line III—III of FIG. 2.

This molded heat insulator 12, as shown in FIGS. 1 through 3, is incorporated preferably between the outer leather wall member 11 and the inner wall member 14 and on the outer surface of the overall surface covering heat insulator 13.

FIGS. 5 through 8 show other forms of molded heat insulator 12. In these figures, the same reference numerals indicate the same elements.

Figure 5:
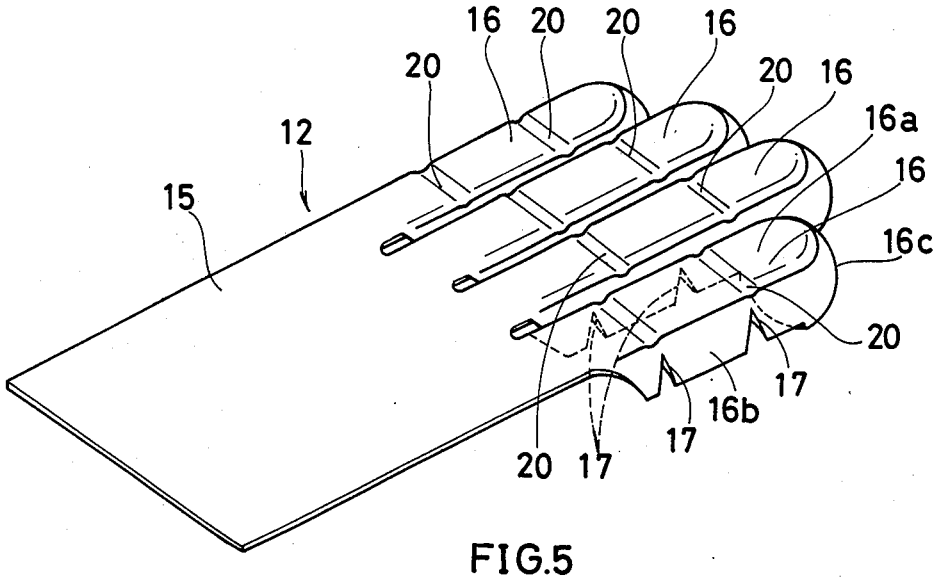
FIG. 5 through 8 are perspective views showing other forms of molded heat insulator.

In the embodiment shown in FIG. 5, the finger joint corresponding portions of the molded heat insulator 12 are formed with folds 20 which make it easier to bend the molded heat insulator 12 inwardly; thus, the molded heat insulator 12 can be easily bent inwardly. As a result, when the user wearing the glove grips a ski stock (otherwise known as a "ski pole") or the like, he can positively do so by bending his fingers despite the back side 1 being thick, and the grippability with the glove worn is correspondingly improved.

Figure 6:
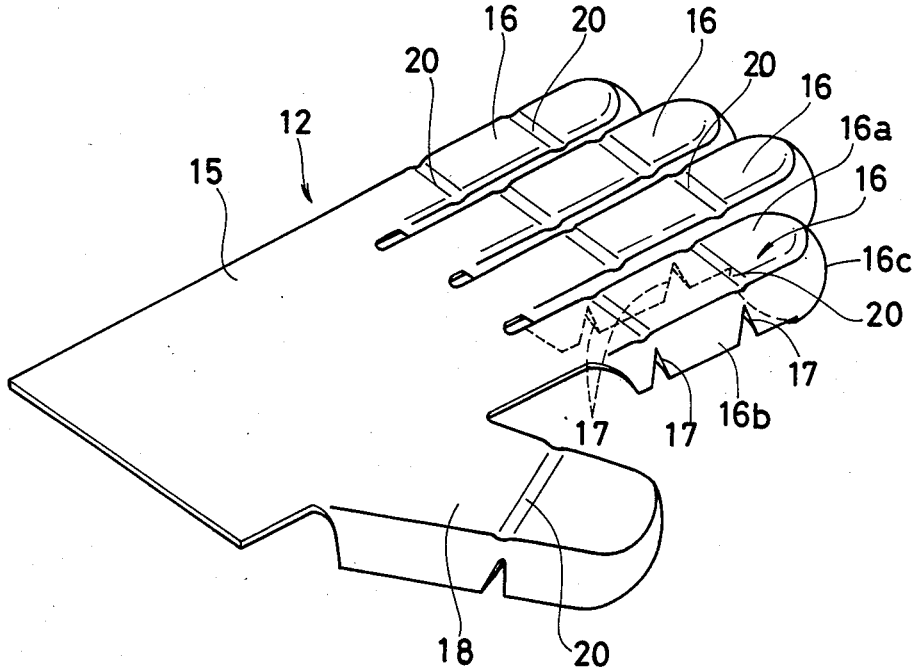

FIG. 6 shows a molded heat insulator 12 according to a third embodiment of the invention. As compared with the molded heat insulator 12 of the embodiment shown in FIG. 5 which comprises the back side covering portion 15 covering the back side 1 and the four finger covering portions 16 covering the four fingers other than the thumb, this molded heat insulator 12 includes a thumb covering portion 18 covering the thumb, whereby protection against the cold is further improved. Further, the finger joint corresponding portion of this thumb covering portion 18 is also formed with a fold 20 similar to those in the other fingers, so as to facilitate the bending of the thumb. The other portions in FIG. 6 are indicated by the same reference characters as those used in the corresponding portions in FIG. 5, and a description thereof is omitted.

In this embodiment, the thumb covering portion 18 is integral with the back covering portion 15 and finger covering portions 16 and is interposed between the outer leather wall member 11 and the inner wall member 14. In other embodiments of the invention, however, the thumb covering portion 18 may be separate from the other portions and interposed between the outer leather wall member 11 and the inner wall member 14.

Figure 7:
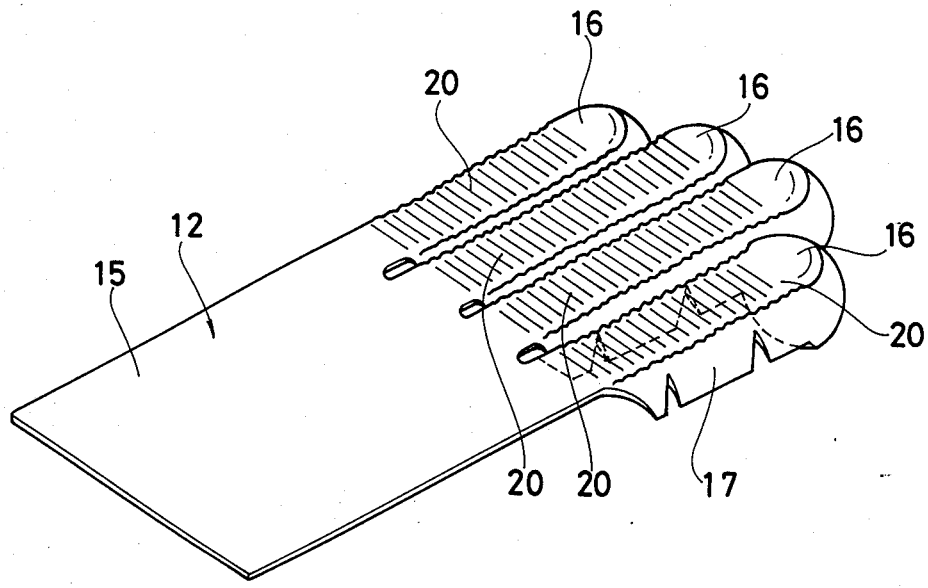

FIG. 7 shows a molded heat insulator 12 according to a fourth embodiment of the invention. Whereas the molded heat insulator 12 in the aforesaid second embodiment has folds 20 formed only in the portions corresponding to the finger joints, this molded heat insulator 12 has said folds 20 formed in a tidal formation in substantially the entire area of each finger 16. In this case, irrespective of the length of the fingers of a person wearing the glove, there are always some folds positioned in opposed relation to the person's finger joints, a fact which is advantageous from the standpoint of increasing the versatility of the glove. Further, since the finger covering portions 16 are smoothly bendable throughout their length, there is another advantage of improved wearing fit between the glove and the person's fingers when he grips a stock or the like.

Figure 8:
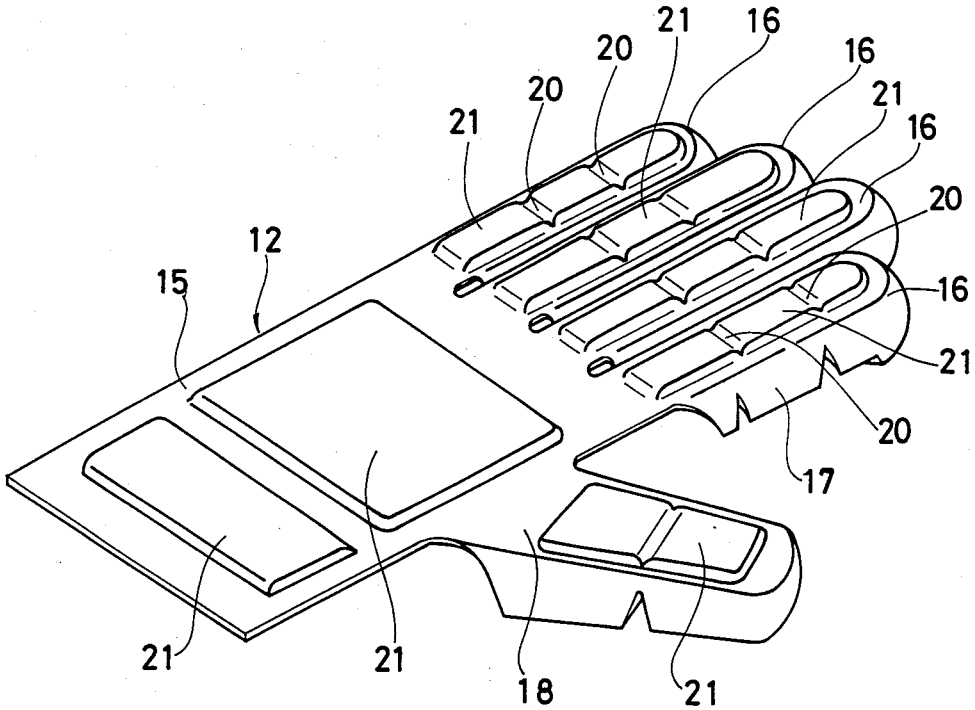

FIG. 8 shows a molded heat insulator 12 according to a fifth embodiment of the invention. In this molded heat insulator 12, the upper surfaces of the back covering portion 15, the finger covering portions 16 and the thumb covering portion 18 are formed with raised portions 21 and folds 20 are formed in the raised portions 21 in the finger covering portions 16 at positions corresponding to the finger joints.

With this arrangement, in addition to the advantage of improved wearing fit due to the folds 20 as in the case of each of the aforesaid embodiments, there is another advantage that the back side and the outer surfaces of the fingers which are exposed when a stock or the like is gripped are guarded by the raised portions 21. Therefore, in the event that the glove accidentally touches a course pole or the like during skiing, there is a safety advantage that a possible bruise on the hand is mitigated by the cushioning action of the raised portions 21.

In addition, each of the molded heat insulators 12 shown in FIGS. 4 through 8 is interposed between the outer leather wall member 11 and the inner wall member 14 and outside the overall covering heat insulator 13, but such molded heat insulator 12 may be directly attached to the outside of the outer leather wall member 11. Further, the overall surface covering heat insulator 13 may be omitted.

FIGS. 9 through 13 show a glove according to an embodiment of the invention having no overall surface covering heat insulator. In this embodiment, interposed between the outer leather wall member 11 and the inner wall member 14 are a molded heat insulator 12 formed of a sheet of relatively soft urethane foam associated with the back side 1 and an intermediate member 26 associated with the palm side 2, said intermediate member being in the form of a soft thin film having waterproofness and moisture permeability.

The outer leather wall member 11 is made by sewing in the usual manner, using natural or synthetic leather.

The inner wall member 14 is made of a material agreeable to the touch, such as cloth.

Figure 10:
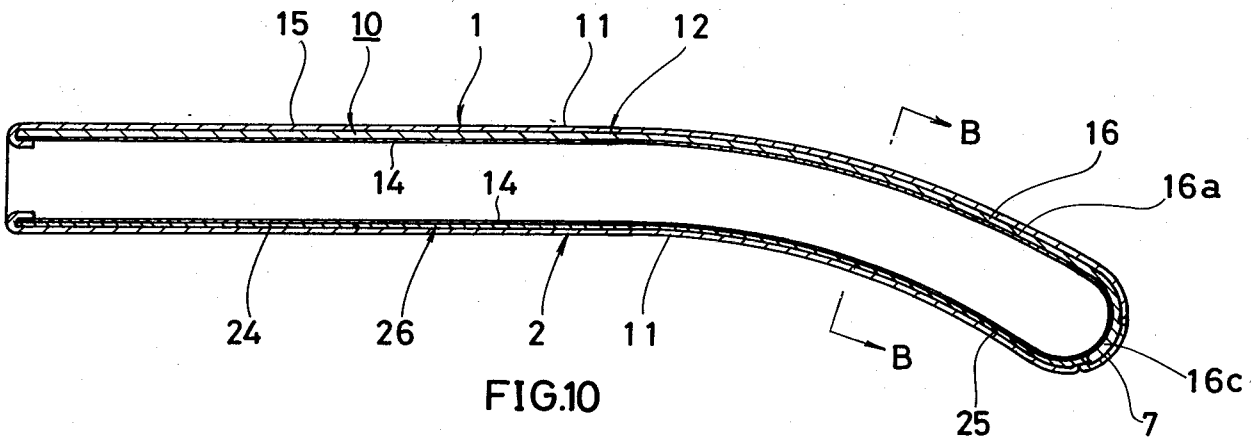
FIG. 10 is a sectional view taken along the line A—A of FIG. 9.
Figure 11:
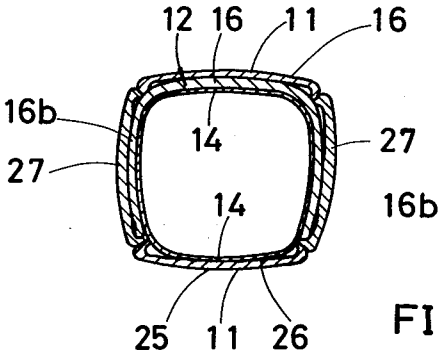
FIG. 11 is a sectional view taken along the line B—B of FIG. 10.
Figure 12:
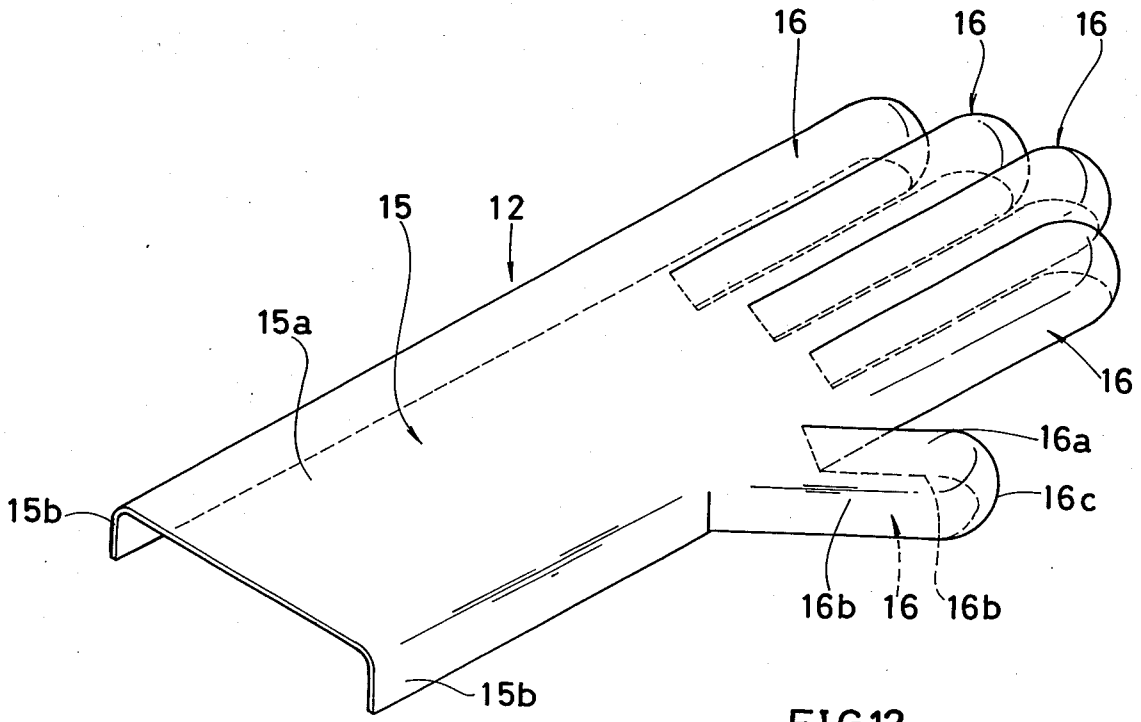
FIG. 12 is a perspective view of a molded heat insulator used for the glove of FIG. 9.

The molded heat insulator 12 installed in the back side 1, as shown in FIG. 12, is formed by integrally molding a back covering portion 15 for covering the back of the glove and finger covering portions 16 for covering the five fingers, by using a sheet of relatively soft urethane foam. The back covering portion 15 has an upper surface covering portion **15*a* having an area covering substantially the entire surface of the back side of the glove and lateral side covering portions 15*b* downwardly extending on opposite sides of said upper surface covering portion 15*a*. The finger covering portions 16, as shown in FIGS. 10 and 11, each have a finger back covering portion 16*a*, opposite lateral side covering portions 16*b*, and a fingertip covering portion 16*c*. In addition, the lower surface of this molded heat insulator 12 is opened throughout the back covering portion 15 and five finger covering portions 16**.

Figure 13:
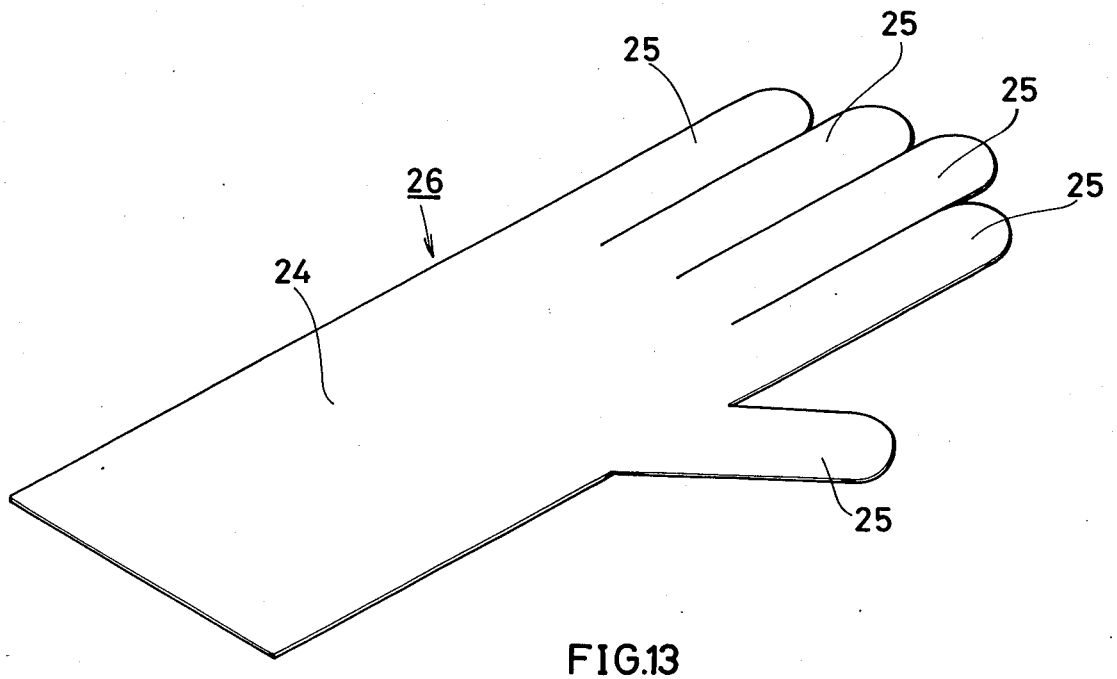
FIG. 13 is a perspective view of an intermediate member for the palm side of the glove of FIG. 9.

The intermediate member 26 installed in the palm side 2, as shown in FIG. 13, has substantially the same area as that of the lower open region of said molded heat insualtor 12. That is, in the intermediate member 26, a palm covering portion 24 and five finger flat covering portions 25 are integrated.

To form this intermediate member 26, a thin sheet formed by foaming polyurethane resin is cut to the shape of a hand. The polyurethane resin used for this intermediate member 26 has such a property that when it is formed into thin film form, it is formed with a number of very small holes. These small holes allow moisture (water vapor) to pass therethrough but prevent water from passing therethrough. As an example, this intermediate member 6 has a moisture permeability of about 5000–7000 $g/m^2 \cdot 24$ h.

The molded heat insulator 12 and intermediate member 26 are bonded together into glove form as by heat sealing their outer peripheral edges (excluding the hand insertion opening portion).

Figure 9:
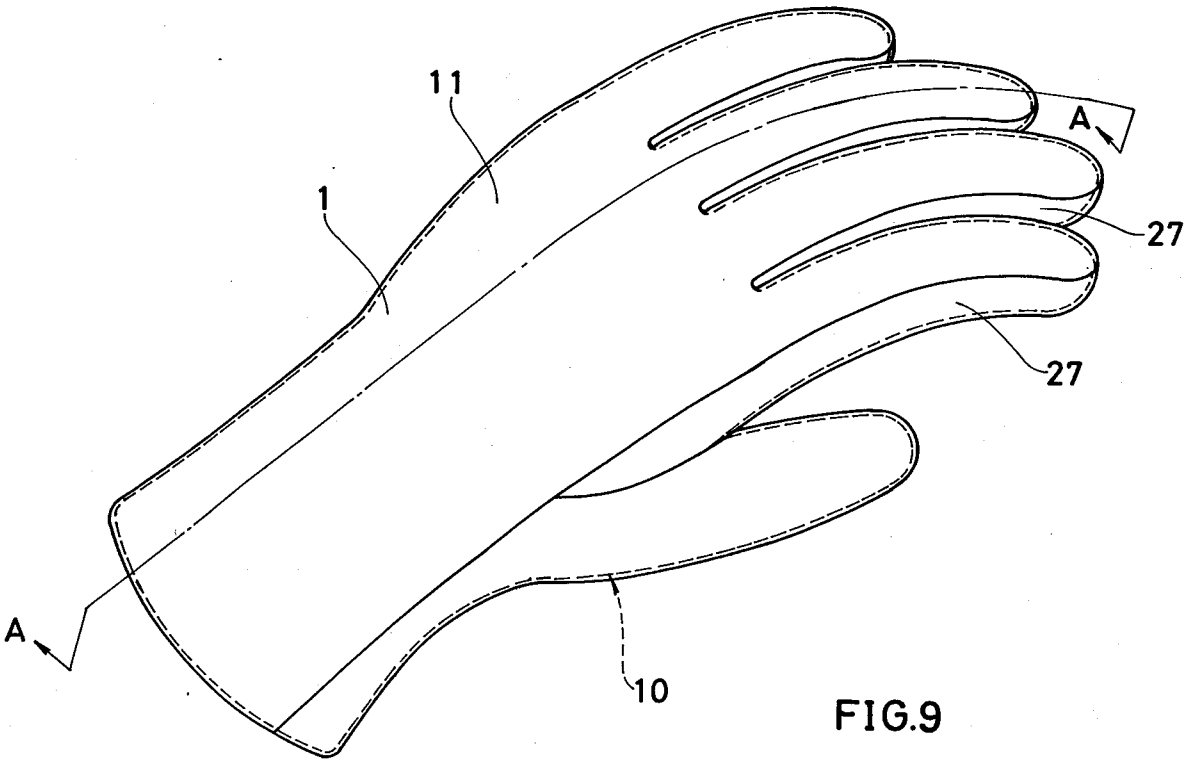
FIG. 9 is a perspective view of a glove according to another embodiment of the invention.

The glove-shaped molding 10 consisting of the molded heat insulator 12 and intermediate member 26 is installed between the outer leather wall member 11 and the inner wall member 14 in the usual manner and shaped into glove form as shown in FIGS. 9 and 10.

In addition, in FIGS. 9 through 11, the numeral 27 denotes girth members interposed between the finger back side wall member and the finger flat side wall member.

When this glove is used (as in gripping a ski stock) the molded heat insulator 12 associated with the back side 1 covers the entire surface of the back side 1 which is liable to be subjected to the wind, thereby securing warmth retention. When a wet object is gripped, water will adhere to the outer surface of the palm side 2, but the presence of the intermediate member 26, which is waterproof, in the palm side 2 prevents water which has entered the outer leather wall member 11 (for example, at the seam) from further penetrating into the glove. Further, since said intermediate member 26 has moisture permeability, moisture which is produced inside the glove by perspiration is vaporized to pass through the inner wall member 14, intermediate member 26 and outer leather wall member 11 associated with the palm side 2 and is dissipated into the atmosphere, whereby the inside of the glove is prevented from becoming stuffy. Further, since the intermediate member 26 is soft and in thin film form, when the user wearing the glove grips an object, the palm side 2 can be easily bent and the grip feel he receives when gripping an object is improved.

In this embodiment, the invention is applied to a glove for sports such as ski, but in other embodiments it may be applied to working gloves (including knit gloves).

According to the glove of the present invention, since the molded heat insulator 12 of flexible material for covering only the back side 1 and fingertips 7 is interposed between the outer leather wall member 11 and inner wall member 14, the back side 1 and fingertips 7 which are liable to be subjected to the wind when the glove is used (as in gripping a ski stock) are protected against the cold by the molded heat insulator 12. Further, despite the fact that the glove is so designed for protection against the cold, there is no danger of the bendability of the palm side of the glove being impaired.

What is claimed is:

1. In a glove comprising an outer leather wall member, an inner wall member and an overall surface covering heat insulator interposed between the outer leather wall member and the inner wall member, the improvement wherein a molded heat insulator is further interposed between said outer leather wall member and said overall surface covering heat insulator only in the back portion of the glove including the fingertip portions, and wherein said molded heat insulator is made of relatively soft foam resin material and comprises:

(a) a back covering portion and at least four finger covering portions extending from one end of said back covering portion, said back covering portion and said finger covering portions having downwardly facing open sides, respectively;

(b) said finger covering portions each comprising a finger back covering portion, a pair of opposed lateral finger side covering portions and a fingertip covering portion;

(c) said pair of finger side covering portions being thinned gradually toward the finger flat sides and defining a plurality of opposed pairs of notches at positions corresponding to the finger joints.

2. A glove as set forth in claim 1, wherein the number of said finger covering portions of said molded heat insulator is four.

3. A glove as set forth in claim 1, wherein the number of said finger covering portions of said molded heat insulator is five.

4. A glove as set forth in claim 1, wherein each finger back covering portion has folds formed in a tidal formation in substantially the entire area of each finger covering portion.

5. A glove as set forth in claim 1, wherein the outer leather wall member (11) is formed of natural or synthetic leather, the inner wall member (14) is formed of cloth, and the molded heat insulator (12) is made of foam resin.

6. A glove as set forth in claim 1, wherein each finger back covering portion (16*a*) has folds (20) formed in its finger joint corresponding portions for facilitating its inward bending.

7. A glove as set forth in claim 6, wherein said folds (20) are in the form of linear recesses formed in the finger back covering portions (16*a*).

8. A glove as set forth in claim 7, wherein said folds (20) are provided substantially throughout the finger back covering portions (16*a*).

* * * * *